US012618357B2

(12) United States Patent
Yamaguchi

(10) Patent No.: US 12,618,357 B2
(45) Date of Patent: May 5, 2026

(54) CYLINDER BLOCK

(71) Applicant: TOYOTA JIDOSHA KABUSHIKI KAISHA, Toyota (JP)

(72) Inventor: Yosuke Yamaguchi, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 19/038,990

(22) Filed: Jan. 28, 2025

(65) Prior Publication Data

US 2025/0369384 A1 Dec. 4, 2025

(30) Foreign Application Priority Data

May 31, 2024 (JP) ..... 2024-088628

(51) Int. Cl.
*F02B 75/18* (2006.01)
*F01P 3/02* (2006.01)

(52) U.S. Cl.
CPC ..... *F01P 3/02* (2013.01); *F01P 2003/021* (2013.01)

(58) Field of Classification Search
CPC ..... F02F 1/14; F02F 1/16; F01P 3/02; F01P 2003/021; F01P 2003/024
USPC ..... 123/41.74
See application file for complete search history.

(56) References Cited

U.S. PATENT DOCUMENTS 11,378,036 B2 * 7/2022 Craft ..... F02F 11/002
2016/0040621 A1 * 2/2016 Beyer ..... F02F 1/14 164/112

FOREIGN PATENT DOCUMENTS

JP H10-288080 A 10/1998

* cited by examiner

*Primary Examiner* — Hung Q Nguyen
*Assistant Examiner* — James J Kim
(74) *Attorney, Agent, or Firm* — SoraIP, Inc.

(57) ABSTRACT

The cylinder block includes a plurality of cylinder bores, a water jacket surrounding the plurality of cylinder bores, and a through channel that extends between adjacent cylinder bores and through which the coolant from the water jacket 30 flows. The through channel has a first upstream channel having an upstream end connected to the water jacket, a second upstream channel having an upstream end connected to the water jacket, and a downstream channel connected to a downstream end of the first upstream channel and a downstream end of the second upstream channel. The channel cross-sectional area of the downstream channel is larger than the channel cross-sectional area of the first upstream channel and is larger than the channel cross-sectional area of the second upstream channel.

4 Claims, 3 Drawing Sheets

CYLINDER BLOCK

CROSS-REFERENCE TO RELATED APPLICATION

This application claims priority to Japanese Patent Application No. 2024-088628 filed on May 31, 2024, incorporated herein by reference in its entirety.

BACKGROUND

1. Technical Field

The present disclosure relates to a cylinder block.

2. Description of Related Art

Japanese Unexamined Patent Application Publication No. 10-288080 (JP 10-288080 A) describes a cylinder block. In the cylinder block, a plurality of cylinder bores, a water jacket, and a drill path that is a through channel, are defined. The cylinder bores are arrayed in a row. The water jacket surrounds the cylinder bores. The through channel extends in a columnar shape.

The through channel has a first upstream channel, a second upstream channel, a first downstream channel, and a second downstream channel. The first upstream channel and the first downstream channel are aligned on a straight line. The second upstream channel and the second downstream channel are aligned on a straight line.

An upstream end of the first upstream channel is connected to the water jacket. A downstream end of the first upstream channel is connected to the first downstream channel and the second downstream channel. An upstream end of the second upstream channel is connected to the water jacket. A downstream end of the second upstream channel is connected to the first downstream channel and the second downstream channel.

SUMMARY

Now, in the cylinder block described in JP 10-288080 A, one downstream channel may be omitted. That is to say, the through channel may have the first upstream channel, the second upstream channel, and a downstream channel in which a lower end of the first upstream channel and a lower end of the second upstream channel are connected to each other. When one downstream channel is omitted in the cylinder block described in JP 10-288080 A, the channel cross-sectional area of the downstream channel is equal to the channel cross-sectional area of the first upstream channel or the second upstream channel. Accordingly, when coolant flows into the downstream channel from the first upstream channel and the second upstream channel, the flow rate of the coolant may decrease.

To solve the above problem, the present disclosure is a cylinder block, including

- a block body, in which are defined
  - a plurality of cylinder bores,
  - a water jacket surrounding a periphery of the cylinder bores, and
  - a through channel extending between the cylinder bores that are adjacent to each other and through which coolant from the water jacket flows, in which
- the through channel includes a first upstream channel of which an upstream end is connected to the water jacket, a second upstream channel of which an upstream end is connected to the water jacket, and a downstream channel that is connected to a downstream end of the first upstream channel and a downstream end of the second upstream channel,
- a downstream-side portion of the first upstream channel, including the downstream end, extends in a columnar shape,
- a downstream-side portion of the second upstream channel, including the downstream end, extends in a columnar shape,
- an upstream-side portion of the downstream channel, including the upstream end, extends in a columnar shape, and
- a channel cross-sectional area of the upstream-side portion of the downstream channel is larger than a channel cross-sectional area of the downstream-side portion of the first upstream channel, and also is larger than the channel cross-sectional area of the downstream-side portion of the second upstream channel.

According to the above configuration, the channel cross-sectional area of the upstream-side portion of the downstream channel is larger than the channel cross-sectional area of the downstream-side portion of the first upstream channel, and also is larger than the channel cross-sectional area of the downstream-side portion of the second upstream channel. Accordingly, decrease in the flow rate of the coolant when the coolant flows into the downstream channel from the first upstream channel and the second upstream channel can be suppressed.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

An embodiment of a cylinder block will be described with reference to the drawings.

Cylinder Block Overview

Figure 1:
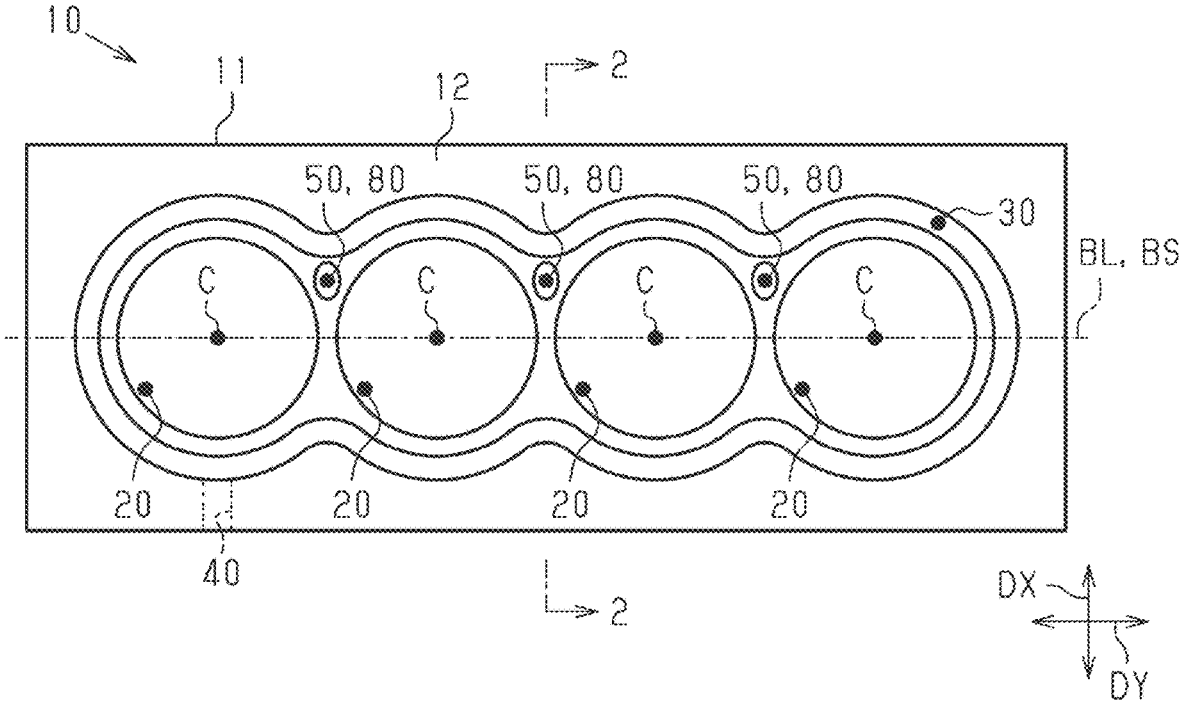
FIG. 1 is a top view of a cylinder block of one embodiment.
Figure 2:
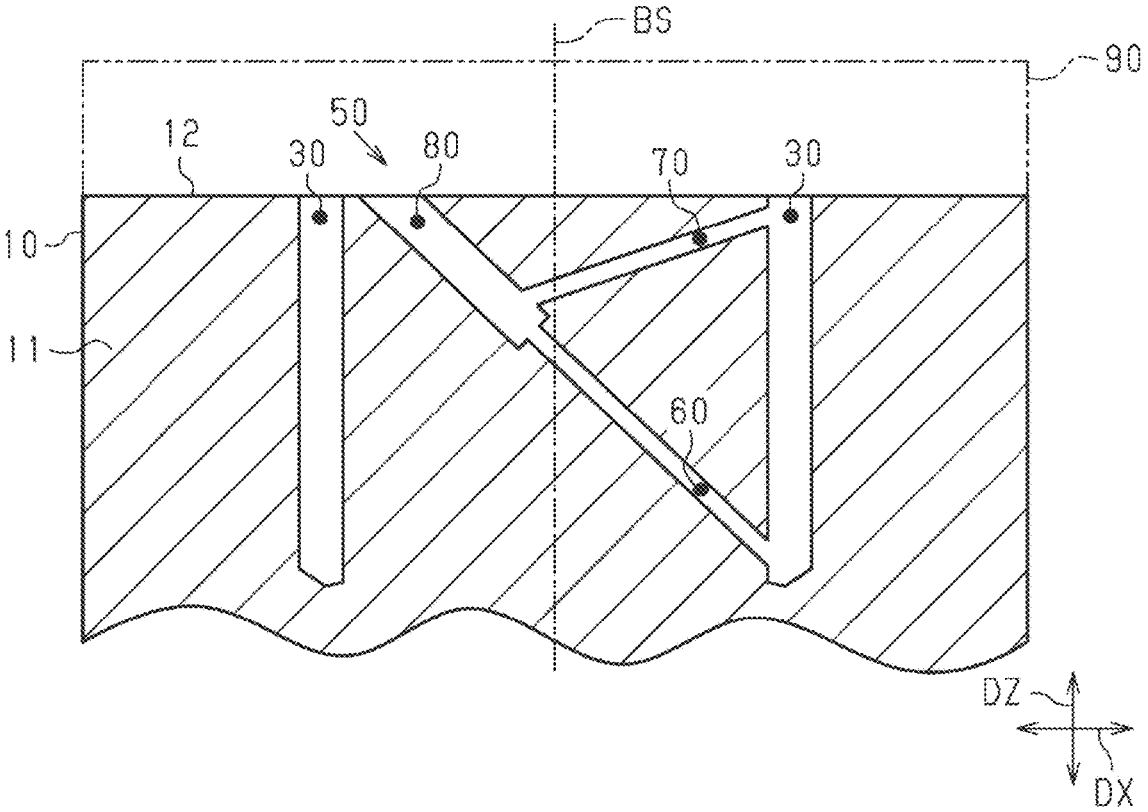
FIG. 2 is a cross-sectional view of the cylinder block taken along line 2-2 of FIG. 1.

As shown in FIG. 1, the cylinder block 10 includes a block body 11. The block body 11 is generally rectangular parallelepiped. The block body 11 has a deck face 12. As shown in FIG. 2, a cylinder head 90 is mounted on the deck face 12.

As illustrated in FIG. 1, the cylinder block 10 includes a plurality of cylinder bores 20, a water jacket 30, and an inflow hole 40. The plurality of cylinder bores 20, the water jacket 30, and the inflow hole 40 are partitioned into the block body 11.

The cylinder bore 20 is capable of accommodating a piston of an internal combustion engine in a reciprocable manner. The cylinder bore 20 is partitioned into a columnar shape. When the cylinder block 10 is viewed from above, the plurality of cylinder bores 20 are arranged such that the center C of each cylinder bore 20 is located on the same straight line. When the cylinder block 10 is viewed from above, a straight line connecting the centers C of the plurality of cylinder bores 20 is defined as a boundary line BL. The boundary line BL passes through the thinnest part of the part located between the cylinder bores 20 of the block body 11.

As shown in FIGS. 1 and 2, in the following explanation, a direction along an axial line in which the cylinder bore 20 extends is referred to as a vertical direction DZ. In the vertical direction DZ, the cylinder bore 20 is positioned below the deck face 12, and the cylinder head 90 is mounted above the deck face 12. Therefore, a viewpoint that faces the deck face 12 and is viewed from above is viewed from above. Further, a direction along the boundary line BL is referred to as a depth direction DY. In addition, a direction perpendicular to both the vertical direction DZ and the depth direction DY is referred to as a width direction DX. Further, a surface including the boundary line BL and perpendicular to the width direction DX is referred to as a boundary plane BS.

As shown in FIG. 1, the water jacket 30 cools the block body 11 by flowing coolant. The water jacket 30 is partitioned into the block body 11. The water jacket 30 surrounds a plurality of cylinder bores 20. That is, the cylinder block 10 is of a so-called Siamese type in which a plurality of cylinders are connected.

The water jacket 30 is open to the deck face 12. The entire region of the upper portion of the water jacket 30 opens into the deck face 12. That is, the cylinder block 10 has a so-called open deck type.

The inflow hole 40 supplies coolant pumped from the water pump to the water jacket 30. The inflow hole 40 is located at substantially the same position as the center C of the cylinder bore 20 located at the end in the depth direction DY.

A part of the opening of the deck face 12 of the water jacket 30 on the side where the inflow hole 40 is not positioned with respect to the boundary plane BS as a boundary is connected to the water jacket in the head of the cylinder head 90 when the cylinder head 90 is mounted. Therefore, the coolant in the water jacket 30 flows from the side where the inflow hole 40 is located to the side where the inflow hole 40 is not located in the water jacket 30 with the boundary plane BS as a whole as the most upstream-side portion.

Therefore, the portion on the side where the inflow hole 40 is located is located on the upstream side of the portion on the side where the inflow hole 40 is not located in the water jacket 30 with the boundary plane BS as the boundary. The water jacket 30 is located upstream of the water jacket in the head of the cylinder head 90.

Through Channel

As shown in FIG. 2, the cylinder block 10 includes a through channel 50. The through channel 50 is partitioned into the block body 11.

The through channel 50 extends between adjacent cylinder bores 20 of the block body 11. The through channel 50 cools a portion of the block body 11, particularly a portion between adjacent cylinder bores 20, by the flow of the coolant from the water jacket 30.

The through channel 50 includes a first upstream channel 60, a second upstream channel 70, and a downstream channel 80. An upstream end of the through channel 50 is an upstream end of the first upstream channel 60. The downstream end of the through channel 50 is the downstream end of the downstream channel 80.

The first upstream channel 60 has a columnar shape. The upstream end of the first upstream channel 60 is connected to a part of the water jacket 30 where the inflow hole 40 is located with the boundary line BL as a boundary. The upstream end of the first upstream channel 60 is connected to the vicinity of the bottom position of the water jacket 30 in the upstream and downstream vertical direction DZ. The downstream end of the first upstream channel 60 is connected to the upstream end of the downstream channel 80. In the width direction DX, the downstream end of the first upstream channel 60 is located closer to the side where the inflow hole 40 is not located than the boundary plane BS. That is, in the present embodiment, all portions including the downstream end of the first upstream channel 60 extend in a columnar shape.

The second upstream channel 70 has a columnar shape. The upstream end of the second upstream channel 70 is connected to a part of the water jacket 30 where the inflow hole 40 is located with the boundary plane BS as a boundary. The upstream end of the second upstream channel 70 is connected to the vicinity of the opening position of the water jacket 30 in the upstream and downstream vertical direction DZ. Therefore, the upstream end of the second upstream channel 70 is positioned higher than the upstream end of the first upstream channel 60. The downstream end of the second upstream channel 70 is connected to the vicinity of the upstream end of the downstream channel 80. The downstream end of the second upstream channel 70 is positioned on the side where the inflow hole 40 is not positioned in the width direction DX relative to the boundary plane BS. That is, in the present embodiment, all portions including the downstream end of the second upstream channel 70 extend in a columnar shape.

The downstream channel 80 has a columnar shape. That is, all portions of the downstream channel 80 including the upstream end extend in a columnar shape. The extending axis of the downstream channel 80 extends parallel to the extending axis of the first upstream channel 60. The extending axis of the downstream channel 80 is aligned with the extending axis of the first upstream channel 60. Therefore, when viewed along the extending axis of the first upstream channel 60, the axis of the first upstream channel 60 coincides with the axis of the downstream channel 80. When viewed along the extending axis of the first upstream channel 60, the first upstream channel 60 overlaps the downstream end of the downstream channel 80.

The downstream end of the downstream channel 80 opens into the deck face 12. Although not shown, the downstream end of the downstream channel 80 leads to an in-head water jacket of the cylinder head 90 when the cylinder head 90 is mounted. Therefore, the downstream end of the first upstream channel 60 and the downstream end of the second upstream channel 70 are located on the same side as the downstream end of the downstream channel 80 with respect to the boundary plane BS in the width direction DX.

The upstream end of the downstream channel 80 is connected to the downstream end of the first upstream channel 60. A side surface near the upstream end of the downstream channel 80 is connected to the downstream end of the second upstream channel 70. The upstream end of the downstream channel 80 is located on the side where the downstream end of the downstream channel 80 is located with respect to the boundary plane BS in the width direction DX. That is, in the width direction DX, the downstream channel 80 extends only from the downstream end to the front of the boundary plane BS and does not extend to the boundary plane BS.

The diameter of the circle of the channel cross section of the first upstream channel 60 is equal to the diameter of the circle of the channel cross section of the second upstream channel 70. Therefore, the channel cross-sectional area of the first upstream channel 60 is equal to the channel cross-sectional area of the second upstream channel 70. The channel cross-sectional area is an area of a cross section orthogonal to the extending axis of the channel.

The diameter of the circle of the channel cross section of the downstream channel 80 is larger than the diameter of the circle of the channel cross section of the first upstream channel 60. The diameter of the circle of the channel cross section of the downstream channel 80 is approximately twice the diameter of the circle of the channel cross section of the first upstream channel 60. Therefore, the channel cross-sectional area of the downstream channel 80 is larger than the channel cross-sectional area of the first upstream channel 60. Further, when viewed along the extending axis of the first upstream channel 60, the entire region of the first upstream channel 60 is located within the range of the outer edge of the downstream channel 80.

The diameter of the circle of the channel cross section of the downstream channel 80 is larger than the diameter of the circle of the channel cross section of the second upstream channel 70. The diameter of the circle of the channel cross section of the downstream channel 80 is approximately twice the diameter of the circle of the channel cross section of the second upstream channel 70. Therefore, the channel cross-sectional area of the downstream channel 80 is larger than the channel cross-sectional area of the second upstream channel 70.

The channel cross-sectional area of the downstream channel 80 is larger than the total value of the channel cross-sectional area of the first upstream channel 60 and the channel cross-sectional area of the second upstream channel 70. Specifically, the channel cross-sectional area of the downstream channel 80 is about four times as large as the total value of the channel cross-sectional area of the first upstream channel 60 and the channel cross-sectional area of the second upstream channel 70. That is, the channel cross-sectional area of the upstream-side portion of the downstream channel 80 is larger than the total value of the channel cross-sectional area of the downstream-side portion of the first upstream channel 60 and the channel cross-sectional area of the downstream-side portion of the second upstream channel 70.

Operation of One Embodiment

In the above-described cylinder block 10, the coolant pumped from the water pump is supplied to the water jacket 30 via the inflow hole 40. The coolant supplied to the water jacket 30 flows from the upstream side to the downstream side through the water jacket 30, and also flows to the through channel 50. In the through channel 50, the coolant flows from the upstream end to the downstream end of the first upstream channel 60. Further, the coolant flows from the upstream end to the downstream end of the second upstream channel 70. coolant flowing from the first upstream channel 60 and coolant flowing from the second upstream channel 70 merge with each other in the vicinity of the upstream end of the downstream channel 80.

Effect of One Embodiment (1) In the above-described embodiment, the channel cross-sectional area of the upstream side portion of the downstream channel 80 is larger than the channel cross-sectional area of the downstream-side portion of the first upstream channel 60, and is larger than the channel cross-sectional area of the downstream-side portion of the second upstream channel 70. Therefore, when the coolant flows from the first upstream channel 60 and the second upstream channel 70 into the downstream channel 80, it is possible to suppress a decrease in the flow rate of the coolant.

(2) In the above-described embodiment, the channel cross-sectional area of the downstream channel 80 is larger than the total value of the channel cross-sectional area of the first upstream channel 60 and the channel cross-sectional area of the second upstream channel 70. Therefore, when flowing into the downstream channel 80 from the first upstream channel 60 and the second upstream channel 70, it is possible to suppress insufficient flow rate of the coolant that can flow.

(3) In the above-described embodiment, in the width direction DX, the downstream end of the first upstream channel 60 and the downstream end of the second upstream channel 70 are located on the same side as the downstream end of the downstream channel 80 with respect to the boundary plane BS. The upstream end of the downstream channel 80 is located on the same side as the downstream end of the downstream channel 80 with respect to the boundary plane BS in the width direction DX.

On the boundary plane BS, since the distances between the adjacent cylinder bores 20 are shortened, when the cross section of the through channel 50 is increased, the entire cylinder block 10 needs to be increased. According to the above-described embodiment, the downstream end of the downstream channel 80 is kept at the same level as the downstream end of the downstream channel 80 with respect to the boundary plane BS in the width direction DX, so that it is possible to prevent the entire cylinder block 10 from becoming large in the depth direction DY.

(4) The downstream end of the downstream channel 80 opens into the deck face 12. The first upstream channel 60 has a columnar shape. The downstream channel 80 has a columnar shape. When viewed along the central axis of the first upstream channel 60, the first upstream channel 60 overlaps the downstream end of the downstream channel 80. According to the above-described embodiment, the manufacturer of the cylinder block 10 first processes the hole having the diameter of the circle of the channel section of the first upstream channel 60 from the position where the downstream end of the downstream channel 80 is positioned. Thereafter, the manufacturer can form the downstream channel 80 and the first upstream channel 60 by processing the hole having the diameter of the circle of the channel cross section of the downstream channel 80 from the position where the downstream end of the downstream channel 80 is located. Therefore, the cylinder block 10 does not require excessively complicated work to manufacture.

(5) When viewed along the extending axis of the first upstream channel 60, the entire region of the first upstream channel 60 is located within the range of the outer edge of the downstream channel 80. According to the above-described embodiment, the manufacturer of the cylinder block 10 first processes the hole having the diameter of the circle of the channel section of the first upstream channel 60 from the position where the downstream end of the downstream channel 80 is positioned. Thereafter, the manufacturer can form the downstream channel 80 by processing a hole having a diameter larger than that of the hole having the diameter of the circle of the channel cross section of the first upstream channel 60 using the hole as a guide. Therefore, the cylinder block 10 is easily processed when the downstream channel 80 is formed.

Other Embodiments

The above embodiment can be carried out while being modified as follows. The present embodiment and modification examples described below may be carried out in combination of each other within a technically consistent range. Note that, in the drawings showing modification examples, the same members are denoted by the same reference numerals as those of the above-described embodiment, and description thereof will be omitted.

In the above embodiment, the cylinder block 10 may have three or more upstream channels.

Figure 3:
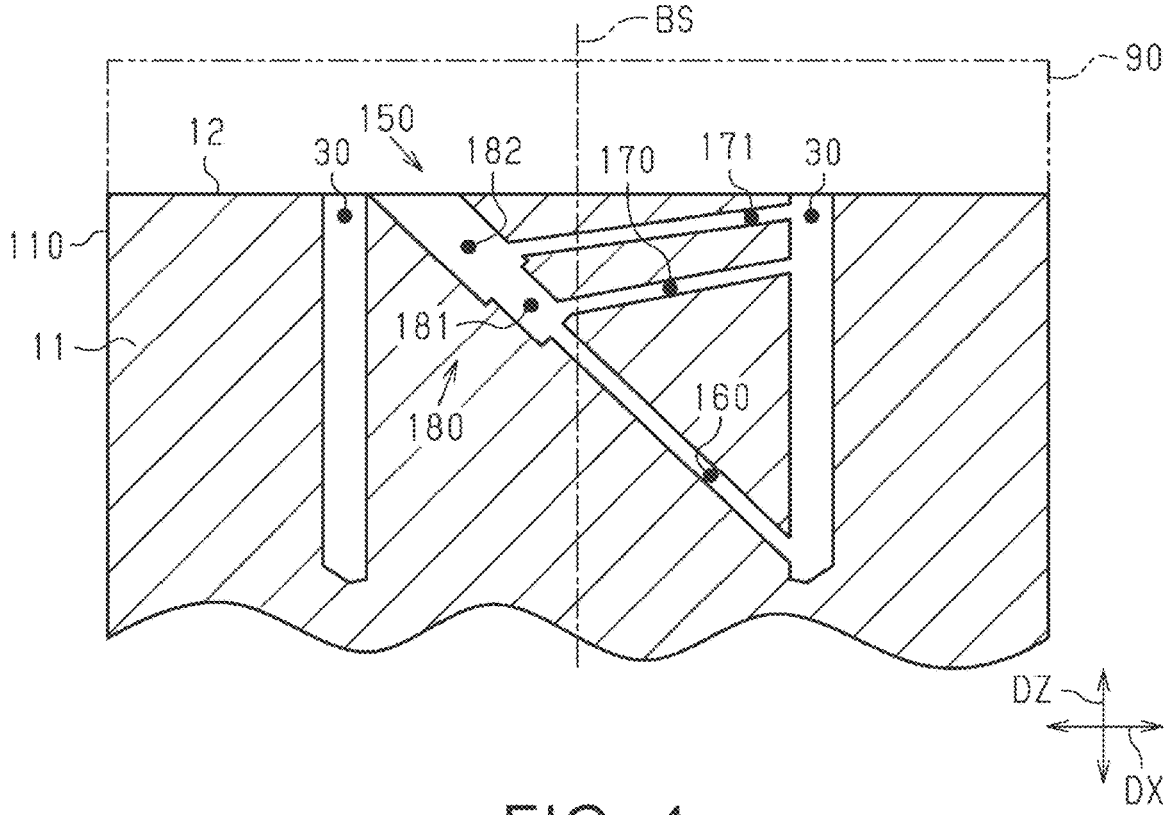
FIG. 3 is a cross-sectional view of a modified cylinder block.

As shown in FIG. 3, the cylinder block 110 of the modified example has a through channel 150. The through channel 150 has a first upstream channel 160, a second upstream channel 170, and a third upstream channel 171 as a plurality of upstream channels. The upstream end of the third upstream channel 171 is positioned higher than the upstream end of the second upstream channel 170 in the vertical direction DZ.

The through channel 150 has a first downstream channel 181 and a second downstream channel 182 as the downstream channel 180. The first downstream channel 181 and the second downstream channel 182 are aligned on the axis of the first upstream channel 160.

The first downstream channel 181 has a columnar shape. The first downstream channel 181 includes an upstream end of the downstream channel 180. The second downstream channel 182 has a columnar shape. The diameter of the circle of the channel cross section of the second downstream channel 182 is larger than the diameter of the circle of the channel cross section of the first downstream channel 181.

The downstream end of the first upstream channel 160 and the downstream end of the second upstream channel 170 are connected to the first downstream channel 181. The channel cross-sectional area of the first downstream channel 181 is larger than the total value of the channel cross-sectional area of the first upstream channel 160 and the channel cross-sectional area of the second upstream channel 170.

The downstream end of the third upstream channel 171 is connected to the second downstream channel 182. The channel cross-sectional area of the second downstream channel 182 is larger than the total value of the channel cross-sectional area of the first upstream channel 160 and the channel cross-sectional area of the third upstream channel 171. In the above modification, the first downstream channel 181 including the upstream end of the downstream channel 180 extends in a columnar shape. The channel cross-sectional area of the first downstream channel 181 is larger than the channel cross-sectional area of the first upstream channel 160. Further, the channel cross-sectional area of the second upstream channel 170 is larger than that of the channel.

As described above, in the through channel 150 where the flow passages merge a plurality of times, the channel cross-sectional area of the flow passages after the merging may be larger than any of the channel cross-sectional area of the flow passages before the merging for each merging portion. In this case, the cylinder block 110 can prevent the coolant from hindering the flow due to insufficient flow rate at each joining point.

In the above-described embodiment, the first upstream channel 60 may not be linear.

Figure 4:
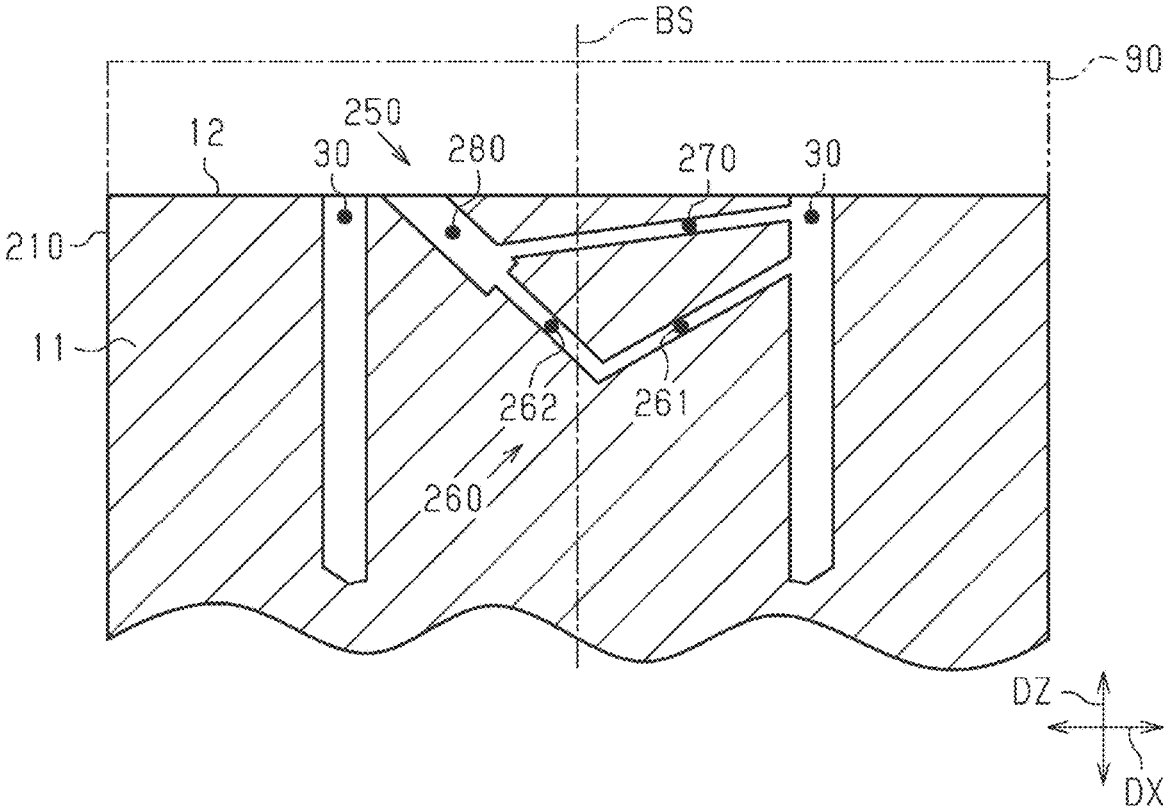
FIG. 4 is a cross-sectional view of a modified cylinder block.

As shown in FIG. 4, the cylinder block 210 of the modified example has a through channel 250. The through channel 250 has a first upstream channel 260, a second upstream channel 270, and a downstream channel 280. The first upstream channel 260 includes a columnar first portion 261 and a columnar second portion 262. The extending axis of the second portion 262 is located on the extending axis of the downstream channel 280. The downstream end of the second portion 262 is connected to the upstream end of the downstream channel 280. On the other hand, the extending axis of the first portion 261 extends across the extending axis of the second portion 262. The downstream end of the first portion 261 is connected to the upstream end of the second portion 262. In this modification, the upstream end of the first portion 261 is located above the center of the water jacket 30 in the vertical direction DZ. The downstream end of the first portion 261 is located lower than the upstream end of the first portion 261 in the vertical direction DZ. In the above modification, the second portion 262, which is a downstream-side portion including the downstream end of the first upstream channel 260, extends in a columnar shape. In this case, the channel cross-sectional area of the downstream channel 280 may be larger than the channel cross-sectional area of the second portion 262.

As described above, the first upstream channel 260 may not extend in a single straight line, or may be constituted by a plurality of straight portions. The cylinder block 210 is processed from the side where the inflow hole 40 of the water jacket 30 is located on the first portion 261 at the time of manufacturing. Further, the second portion 262 is processed from the side where the inflow hole 40 of the water jacket 30 is not positioned. Thus, it is not necessary to process an excessively deep hole.

In the above-described embodiment, the downstream end of the through channel 50 may not be open to the deck face 12.

Figure 5:
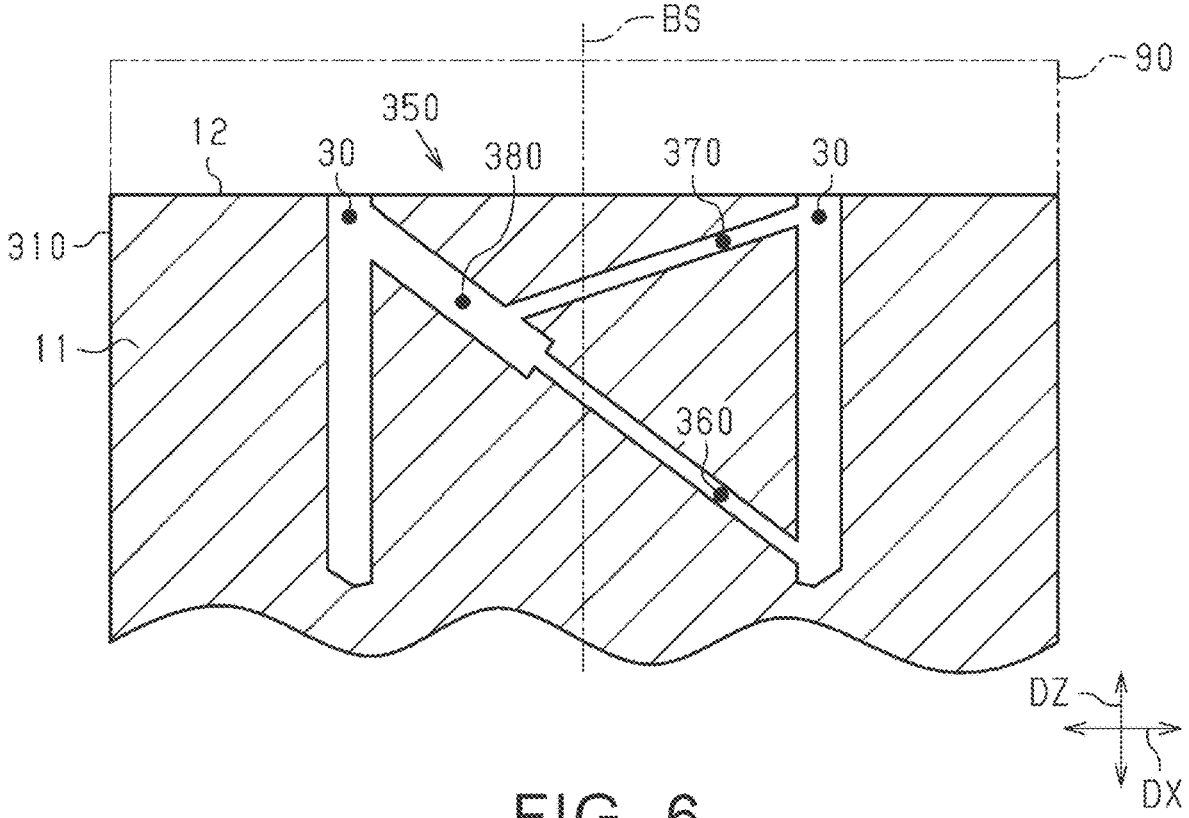
FIG. 5 is a cross-sectional view of a modified cylinder block.

As shown in FIG. 5, the cylinder block 310 of the modified example has a through channel 350. The through channel 350 has a first upstream channel 360, a second upstream channel 370, and a downstream channel 380. The downstream end of the downstream channel 380 is the downstream end of the through channel 350. The downstream end of the downstream channel 380 is positioned in the width direction DX away from the upstream end of the first upstream channel 360 with respect to the boundary plane BS. The downstream end of the downstream channel 380 is connected to the water jacket 30.

As described above, the downstream end of the through channel 350 may not be open to the deck face 12 but may be connected to the water jacket 30. When connected to the water jacket 30, the coolant can flow through the through channel 350 even if the water jacket in the head of the cylinder head 90 is not connected to the through channel 350.

In the above-described embodiment, when viewed along the extending axis of the first upstream channel 60, the first upstream channel 60 may not overlap with the downstream end of the downstream channel 80.

Figure 6:
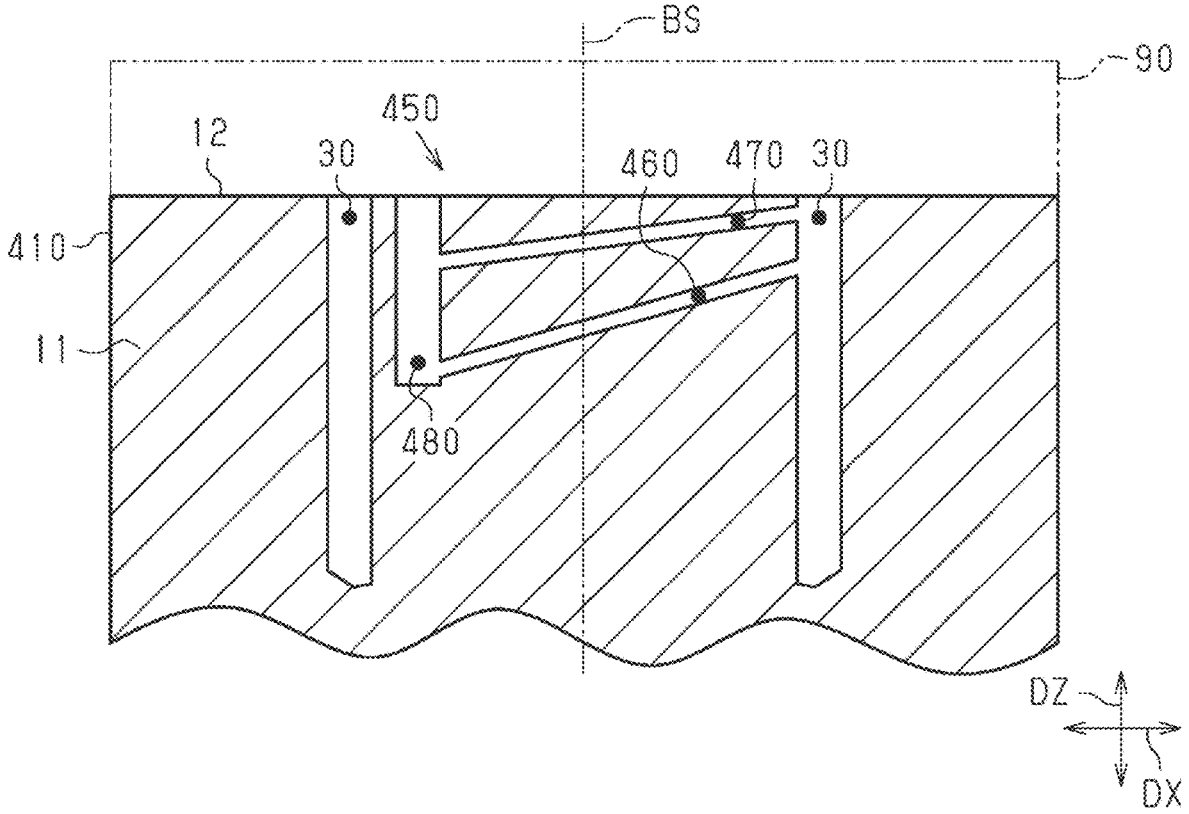
FIG. 6 is a cross-sectional view of a modified cylinder block.

As shown in FIG. 6, the cylinder block 410 of the modified example has a through channel 450. The through channel 450 has a first upstream channel 460, a second upstream channel 470, and a downstream channel 480. The downstream channel 480 extends substantially parallel to the vertical direction DZ. The extending axis of the first upstream channel 460 intersects the extending axis of the downstream channel 480. The upstream end of the first upstream channel 460 is located above the center of the water jacket 30 in the vertical direction DZ. The downstream end of the first upstream channel 460 is positioned lower than the upstream end of the first upstream channel 460 in the vertical direction DZ. Therefore, when viewed along the extending axis of the first upstream channel 460, the first upstream channel 460 does not overlap with the downstream end of the downstream channel 480.

In this case, the first upstream channel 460 may be processed from the side where the inflow hole 40 of the water jacket 30 is located, and the downstream channel 480 may be processed from the side where the inflow hole 40 of the water jacket 30 is not located.

In the above-described embodiment, when viewed along the extending axis of the first upstream channel 60, the entire region of the first upstream channel 60 may not be located within the range of the outer edge of the downstream channel 80. That is, a portion of the first upstream channel 60 may be located outside the range of the outer edge of the downstream channel 80. That is, when viewed along the extending axis of the first upstream channel 60, even if the entire region of the first upstream channel 60 is not located within the range of the outer edge of the downstream channel 80, a portion of the first upstream channel 60 may overlap with the downstream end of the downstream channel 80.

In the above-described embodiment, in the width direction DX, the downstream end of the downstream channel 80 may be located opposite to the downstream end of the downstream channel 80 with respect to the boundary plane BS. In this case, the downstream end of the first upstream channel 60 and the downstream end of the second upstream channel 70 may be located on the side where the upstream end of the first upstream channel 60 is located with respect to the boundary plane BS. If the block body 11 has a sufficient wall thickness between the adjacent cylinder bores 20, the downstream channel 80 can be extended in this manner.

In the above-described embodiment, the channel cross-sectional area of the downstream channel 80 may be equal to or smaller than the total value of the channel cross-sectional area of the first upstream channel 60 and the channel cross-sectional area of the second upstream channel 70. The channel cross-sectional area of the downstream channel 80 is larger than the channel cross-sectional area of the first upstream channel 60, and when the channel cross-sectional area is larger than the channel cross-sectional area of the second upstream channel 70, a decrease in the flow rate can be suppressed.

In the above-described embodiment, the entire channel may not be columnar. In this case, it is sufficient that the downstream-side portion including the downstream end of the first upstream channel 60, the downstream-side portion including the downstream end of the second upstream channel 70, and the upstream-side portion including the upstream end of the downstream channel 80 are columnar. For example, these portions may have a prismatic shape or a columnar shape having an elliptical cross section. The channel cross-sectional area of the upstream-side portion of the downstream channel 80 may be larger than the channel cross-sectional area of the downstream-side portion of the first upstream channel 60, and may be larger than the channel cross-sectional area of the downstream-side portion of the second upstream channel 70.

The position of the inflow hole 40 is not limited to the example of the above-described embodiment. For example, it may be located between adjacent cylinder bores 20 in the depth direction DY. In the width direction DX, the position of the inflow hole 40 may be appropriately changed as long as the relation between the upstream side and the downstream side of the coolant does not change between the one side and the other side of the boundary plane BS.

What is claimed is:

1. A cylinder block, comprising:

a block body, in which are defined a plurality of cylinder bores, a water jacket surrounding a periphery of the cylinder bores, and a through channel that extends between the cylinder bores adjacent to each other and through which coolant from the water jacket flows, wherein the through channel includes a first upstream channel of which an upstream end is connected to the water jacket, a second upstream channel of which an upstream end is connected to the water jacket, and a downstream channel that is connected to a downstream end of the first upstream channel and a downstream end of the second upstream channel, a downstream-side portion of the first upstream channel, including the downstream end, extends in a columnar shape, a downstream-side portion of the second upstream channel, including the downstream end, extends in a columnar shape, an upstream-side portion of the downstream channel, including the upstream end, extends in a columnar shape, and a channel cross-sectional area of the upstream-side portion of the downstream channel is larger than a channel cross-sectional area of the downstream-side portion of the first upstream channel, and also is larger than the channel cross-sectional area of the downstream-side portion of the second upstream channel, wherein the downstream end of the downstream channel opens to a deck face, the first upstream channel is columnar, the downstream channel is columnar, and as viewed along an axis extending from the first upstream channel, the first upstream channel overlaps the downstream end of the downstream channel.

2. The cylinder block according to claim 1, wherein the channel cross-sectional area of the upstream-side portion of the downstream channel is larger than a total value of the channel cross-sectional area of the downstream-side portion of the first upstream channel and the channel cross-sectional area of the downstream-side portion of the second upstream channel.

3. The cylinder block according to claim 1, wherein, with respect to a width direction that is orthogonal to both of a boundary line that is a straight line connecting centers of the cylinder bores that are adjacent to each other as viewed from a direction along axes extending from the cylinder bores, and the axes extending from the cylinder bores, with a plane that includes the boundary line and is orthogonal to the width direction as a boundary plane, the downstream end of the first upstream channel and the downstream end of the second upstream channel are located on the same side as a downstream end of the downstream channel with respect to the boundary plane, and the upstream end of the downstream channel is located on the same side as the downstream end of the downstream channel with respect to the boundary plane.

4. The cylinder block according to claim 1, wherein, as viewed along the axis extending from the first upstream channel, an entire region of the first upstream channel is situated in a range of an outer edge of the downstream channel.

* * * * *